US012043815B2

(12) United States Patent
Doyen

(10) Patent No.: US 12,043,815 B2
(45) **Date of Patent: *Jul. 23, 2024**

(54) METHOD FOR REDUCING AND/OR CONTROLLING ABNORMAL GAS COMBUSTION IN A MARINE ENGINE OR A CONTROLLED-IGNITION ENGINE

(71) Applicant: TOTAL MARKETING SERVICES, Puteaux (FR)

(72) Inventor: Valérie Doyen, Solaize (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 17/604,465

(22) PCT Filed: Apr. 17, 2020

(86) PCT No.: PCT/EP2020/060835
§ 371 (c)(1),
(2) Date: Oct. 18, 2021

(87) PCT Pub. No.: WO2020/212562
PCT Pub. Date: Oct. 22, 2020

(65) Prior Publication Data

US 2022/0213402 A1 Jul. 7, 2022

(30) Foreign Application Priority Data

Apr. 18, 2019 (FR) ..... 19 04164

(51) Int. Cl.
*C10M 145/14* (2006.01)
*C10N 30/00* (2006.01)
*C10N 40/26* (2006.01)

(52) U.S. Cl.
CPC .. *C10M 145/14* (2013.01); *C10M 2203/1006* (2013.01); *C10M 2203/1025* (2013.01);
(Continued)

(58) Field of Classification Search
CPC ..... C10M 145/14; C10M 2203/1006; C10M 2203/1025; C10M 2209/084; C10N 2030/78; C10N 2040/26; C10N 2040/255
See application file for complete search history.

(56) References Cited

U.S. PATENT DOCUMENTS 11,034,909 B2 * 6/2021 Lançon ..... C10M 145/14
2006/0240999 A1 * 10/2006 Placek ..... C10M 145/14
508/472

(Continued)

FOREIGN PATENT DOCUMENTS

CN 106232785 A 12/2016
CN 107949628 A 4/2018

(Continued)

OTHER PUBLICATIONS

Rapport De Recherche Préliminaire issued in French Patent Application No. 19 04164 dated Jan. 8, 2020.

(Continued)

*Primary Examiner* — Ellen M McAvoy
(74) *Attorney, Agent, or Firm* — TROUTMAN PEPPER HAMILTON SANDERS LLP

(57) ABSTRACT

The present invention relates to the use of a copolymer (C) comprising repeat units corresponding to alkyl methacrylate monomers, said monomers comprising at least one or more monomer(s) (A), the same or different, selected from among (C6-C10) alkyl methacrylate monomers; one or more monomer(s) (B), the same or different, selected from among (C10-C18) alkyl methacrylate monomers, in a lubricant composition comprising at least one base oil for reducing (Continued)

and/or controlling abnormal gas combustion in an engine, preferably a marine engine or a controlled-ignition engine.

14 Claims, 2 Drawing Sheets

(52) U.S. Cl.
CPC ... *C10M 2209/084* (2013.01); *C10N 2030/78* (2020.05); *C10N 2040/26* (2013.01)

(56) References Cited

U.S. PATENT DOCUMENTS

| | | | | |
|---|---|---|---|---|
| 2018/0371356 | A1* | 12/2018 | Roussel | C10M 133/54 |
| 2019/0177642 | A1* | 6/2019 | Lançon | C10M 169/044 |
| 2019/0177643 | A1* | 6/2019 | Lancon | C10M 133/54 |

FOREIGN PATENT DOCUMENTS

| | | | | | |
|---|---|---|---|---|---|
| CN | 109328226 | A | | 2/2019 | |
| CN | 109415648 | A | | 3/2019 | |
| EP | 3 257 919 | A1 | | 12/2017 | |
| EP | 3 257 920 | A1 | | 12/2017 | |
| EP | 3680313 | A1 | * | 7/2020 | C10M 145/14 |
| FR | 3 043 691 | A1 | | 5/2017 | |
| FR | 3 065 964 | A1 | | 11/2018 | |
| JP | 2019518122 | A | * | 6/2019 | C10M 169/04 |
| WO | 2017/081116 | A1 | | 5/2017 | |
| WO | 2017/216332 | A1 | | 12/2017 | |
| WO | WO-2017216326 | A1 | * | 12/2017 | C10M 133/54 |
| WO | 2018/202743 | A1 | | 11/2018 | |

OTHER PUBLICATIONS

Rapport De Recherche Internationale issued in International Patent Application No. PCT/EP2020/060835 dated Jul. 10, 2020.

* cited by examiner

METHOD FOR REDUCING AND/OR CONTROLLING ABNORMAL GAS COMBUSTION IN A MARINE ENGINE OR A CONTROLLED-IGNITION ENGINE

CROSS REFERENCE TO RELATED APPLICATIONS

The present application is a U.S. National Phase Application under 35 U.S.C. § 371 of International Patent Application No. PCT/EP2020/060835 filed Apr. 17, 2020, which claims priority of French Patent Application No. 19 04164 filed Apr. 18, 2019. The entire contents of which are hereby incorporated by reference.

FIELD OF INVENTION

The present invention concerns the reducing and/or controlling of abnormal gas combustion in a marine engine or controlled-ignition engine.

BACKGROUND

The subject of the present invention is the use of one or more polymers in a lubricant composition to reduce and/or control abnormal gas combustion in a marine engine or controlled-ignition engine.

A further subject of the present invention is a method for reducing and/or controlling abnormal gas combustion in a marine engine or controlled-ignition engine.

A further subject of the present invention is a lubricant composition and use thereof to reduce and/or control abnormal gas combustion in a marine engine or controlled-ignition engine.

The marine propulsion industry works towards increasing the efficiency of gas-operated marine engines and as a result the latter have come to operate under increasingly heavier loads. However, the low rotation speed associated with high loads promotes the onset of abnormal combustion phenomena possibly causing destruction of the engine. Pre-ignition, characterized by auto-igniting of the air-gas premixture before normal commanding of ignition leads to an abnormal increase in pressure in the cylinder of the gas engine.

In general, combustion of the gas or more specifically of the air/gas mixture in a marine engine or controlled-ignition engine is initiated by controlled ignition prompted either by contact between an electric arc and the gas, or by injection of pilot liquid fuel initiating a diffusion flame. Controlled ignition can be obtained directly in the combustion chamber of the marine engine or in a pre-combustion chamber of the marine engine adjoining the combustion chamber thereof.

The term of controlled gas combustion is used when it is initiated directly by controlled ignition. This controlled combustion is generally characterized by controlled expansion of the flame front across the combustion chamber. Controlled combustion can also be called normal combustion.

With intake air, the droplets (or particles) of lubricant are entrained into the combustion chamber. The air/gas mixture can auto-ignite prematurely before controlled ignition, in particular through auto-ignition of the lubricant composition in the combustion chamber. This is known as a phenomenon of uncontrolled pre-ignition. This uncontrolled pre-ignition phenomenon translates as abnormal gas combustion characterized by uncontrolled expansion of the flame front across the combustion chamber.

This abnormal gas combustion generates a strong increase in temperature and pressure in the combustion chamber. It has been ascertained that these conditions of abnormally high temperature and pressure conditions have a significant negative impact on the efficiency and overall performance of a marine engine or controlled ignition engine, and can go as far causing irreversible damage to internal engine parts: cylinders, pistons, spark plugs and valves in the marine engine or controlled-ignition engine.

Throughout its research, the Applicant has evidenced that abnormal gas combustion can result inter alia from auto-ignition of droplets (or particles) of lubricant composition that are present in the combustion chamber during the gas compression cycle and/or gas combustion when a marine engine or controlled-ignition engine is in operation.

It would therefore be of advantage to limit the presence of said droplets (or particles) of lubricant composition in the combustion chamber, which would limit the aforementioned disadvantages.

By "abnormal combustion", it is meant combustion of gas in the combustion chamber initiated by uncontrolled pre-ignition. Abnormal combustion translates as uncontrolled expansion of the flame front across the combustion chamber. Abnormal combustion also translates as a pressure level in the combustion chamber that is at least 10% greater, preferably at least 20% greater, more preferably at least 30% greater than the nominal pressure of gas combustion in a marine engine or controlled-ignition engine. Abnormal combustion is particularly due to auto-ignition of droplets (or particles) of lubricant composition entrained into the combustion chamber by air intake.

By "nominal pressure" it is meant the maximum pressure supported by the parts of an engine under controlled gas combustion in the combustion chamber without risk of degradation of all or some of internal parts of the engine e.g. cylinders, pistons, spark plugs and valves.

By "gas", it is meant a mixture of gas and air. In the meaning of the invention, the mixed gas and air mixture is formed upstream of the combustion chamber or in the combustion chamber before ignition of the marine engine or controlled-ignition engine. The step allowing the gas and air mixture to be obtained is called the pre-mixing step. In the meaning of the invention, the terms "gas" and "mixed gas and air mixture" have equivalent meanings and can replace each other.

The term "homogeneous gas combustion" is used when the gas is pre-mixed with air. In the meaning of the invention, the terms "gas combustion", "combustion of the mixed gas and air mixture", "homogeneous gas combustion" or "homogeneous combustion of the mixed gas and air mixture" have equivalent meanings and can replace each other.

By "marine engine", it is meant a two-stroke or four-stroke marine engine that is solely gas operated, also called a pure gas engine, or which operates with gas and fuel also called a dual-fuel engine. The engines of the invention are in particular 2-stroke or 4-stroke engines in which the lubricant is not pre-mixed with the fuel before intake.

By "controlled-ignition engine", it is meant gasoline engines which can be gasoline engines of two-stroke or four-stroke type, pure gas engines and low-pressure gas dual-fuel engines. Typically, the controlled-ignition engines used in the present invention are Otto cycle engines as opposed to Diesel cycle engines.

In the present invention, by "between xxx and yyy" it is meant that the values xxx and yyy are included in the range.

SUMMARY

The present invention concerns the use of a copolymer (C) comprising repeat units corresponding to alkyl methacrylate monomers, said monomers at least comprising:

one or more monomers (A), the same or different, selected from among (C6-C10) alkyl methacrylate monomers;

one or more monomers (B), the same or different, selected from among (C10-C18) alkyl methacrylate monomers, monomers (B) differing from monomers (A), in a lubricant composition comprising at least one base oil to reduce and/or control abnormal gas combustion in an engine.

Advantageously, the use according to the invention allows limiting of the presence of droplets (or particles) of lubricant composition in the combustion chamber, thereby allowing the reducing and/or controlling of abnormal gas combustion in an engine, said engine possibly being a marine engine or controlled-ignition engine.

Typically, monomers (A) differ from monomers (B). Therefore, copolymer (C) is obtained from at least one monomer (A) and at least one monomer (B).

Typically, if copolymer (C) is obtained from two different monomers of (C10) alkyl methacrylate type, then preferably one of the two monomers will have a C10 linear alkyl chain (in this case it is monomer B) and the other monomer will have a C10 branched alkyl chain (in this case it will be monomer A).

In one particular embodiment, the present invention concerns the use of a copolymer (C) comprising repeat units corresponding to alkyl methacrylate monomers, said monomers comprising at least:

one or more monomers (A), the same or different, selected from among (C6-C9) alkyl methacrylate monomers and alkyl methacrylate monomers having a C10 branched alkyl chain;

one or more monomers (B), the same or different, selected from among (C11-C18) alkyl methacrylate monomers and alkyl methacrylate monomers having a C10 linear alkyl chain, in a lubricant composition comprising at least one base oil to reduce and/or control abnormal gas combustion in an engine, typically by limiting the presence of droplets (or particles) of lubricant composition in the combustion chamber.

Preferably, monomers (B) comprise at least one (C12) alkyl methacrylate.

Monomers (A) and (B) can be linear or branched.

Preferably, copolymer (C) of the invention comprises at least two units derived from monomers: a monomer (A) and a monomer (B) which differ.

Preferably, monomers (B) comprise 50 to 80 weight % of (C12) alkyl methacrylate relative to the total weight of monomers (B), and more preferably 55 to 70 weight %.

Advantageously, monomers (B) also comprise at least one (C14) alkyl methacrylate. Preferably, monomers (B) comprise 15 to 40 weight % of (C14) alkyl methacrylate relative to the total weight of monomers (B), and more preferably 20 to 30 weight %.

Preferably, monomers (B) comprise:

50 to 80 weight % of (C12) alkyl methacrylate relative to the total weight of monomers (B), and more preferably 55 to 70 weight %; and 15 to 40 weight % of (C14) alkyl methacrylate relative to the total weight of monomers (B), and more preferably 20 to 30 weight %.

Copolymer (C) of the invention may also comprise repeat units corresponding to other monomers. Said other monomers can be selected from among (C1-05) alkyl methacrylates, (C19-C24) alkyl methacrylates, crosslinking monomers, (C1-C24) alkyl acrylates, styrene, etc.

In one particular embodiment of the invention, the copolymer is substantially free of monomers differing from monomers (A) and monomers (B) defined in the present invention, in particular free of (C1-05) alkyl methacrylates, for example including methyl methacrylates. In one embodiment, the copolymer used in the invention is substantially free of methyl methacrylate. The monomers of methyl methacrylate type decrease the solubility of the copolymer in oil, which means that this type of monomer is typically used in small amount or is typically absent from the copolymer of the invention.

In the meaning of the present invention and unless otherwise stipulated, the expression "copolymer substantially free of a monomer X" means that the copolymer comprises less than 3.0 weight % of said monomer X, preferably less than 1.0 weight % of said monomer X, more preferably less than 0.5 weight % of said monomer X, relative to the total weight of the copolymer.

Preferably, monomers (A) selected from among (C6-C10) alkyl methacrylate monomers and monomers (B) selected from among (C10-C18) alkyl methacrylate monomers represent at least 75 weight % of the total weight of the monomers used in copolymer (C), preferably at least 90%, more preferably at least 95%, further preferably at least 97%, or better still at least 99 weight %, preferably at least 99.5 weight %.

Preferably, the weight ratio of monomers (B) to monomers (A) in the copolymer is between 99:1 and 10:90.

Advantageously, monomers (A) comprise at least 50 weight % of (C8) alkyl methacrylate relative to the total weight of monomers (A), preferably at least 75%, more preferably at least 90% and further preferably at least 99 weight %.

In one preferred embodiment, monomers (A) are branched monomers (i.e. in which the alkyl portion of the alkyl methacrylate is branched) such as 2-ethyl-hexyl methacrylate or isodecyl methacrylate.

Advantageously, monomers (B) may comprise a mixture of at least one (C10) alkyl methacrylate, (C12) alkyl methacrylate, (C14) alkyl methacrylate, (C16) alkyl methacrylate, (C18) alkyl methacrylate, on the understanding that the C10 alkyl methacrylate preferably has a linear alkyl chain.

More advantageously, monomers (B) may comprise a mixture of at least:

0.1 to 2 weight % of (C10) alkyl methacrylate relative to the weight of monomers (B), typically having a C10 linear alkyl chain;

50 to 80 weight % of (C12) alkyl methacrylate relative to the weight of monomers (B);

15 to 40 weight % of (C14) alkyl methacrylate relative to the weight of monomers (B);

2 to 12 weight % of (C16) alkyl methacrylate relative to the weight of monomers (B);

0.1 to 1 weight % of (C18) alkyl methacrylate relative to the weight of monomers (B).

Preferably. monomers (B) comprise a mixture of at least:

1 to 2 weight % of (C10) alkyl methacrylate relative to the weight of monomers (B), typically having a C10 linear alkyl chain;

55 to 70 weight % of (C12) alkyl methacrylate relative to the weight of monomers (B);

20 to 30 weight % of (C14) alkyl methacrylate relative to the weight of monomers (B);

4 to 10 weight % of (C16) alkyl methacrylate relative to the weight of monomers (B);

0.1 to 0.5 weight % of (C18) alkyl methacrylate relative to the weight of monomers (B).

In one preferred embodiment, monomers (B) are linear and are particularly selected from among n-(C10)-alkyl methacrylate, n-(011)-alkyl methacrylate, lauryl methacrylate (n-(012)-alkyl methacrylate), n-(013)-alkyl methacrylate, myristyl methacrylate (n-(014)-alkyl methacrylate), n-(015)-alkyl methacrylate, n-(016)-alkyl methacrylate, n-(017)-alkyl methacrylate, n-(C18)-alkyl methacrylate.

The ratios of the different monomers can be adapted by persons skilled in the art as a function of the desired characteristics of copolymer (C). For example, the weight ratio monomer (B):monomer (A) can be 10:90, 15:85, 20:80, 25:75, 30:70, 35:65, 40:60, 45:55, 50:50, 55:45, 60:40, 65:35, 70:30, 75:25, 80:20, 85:15, 90:10, 95:5 or 99:1. In particular, the monomers can be contained in a (C10-C18) alkyl methacrylate/(08)alkyl methacrylate weight ratio of 10:90, 15:85, 20:80, 25:75, 30:70, 35:65, 40:60, 45:55, 50:50, 55:45, 60:40, 65:35, 70:30, 75:25, 80:20, 85:15, 90:10, 95:5, or 99:1.

Preferably, in the invention, the alkyl group of (C8) alkyl methacrylate is a linear or branched C8 alkyl. Preferably, the (C8) alkyl methacrylate is 2-ethylhexyl methacrylate.

In one particularly preferred embodiment, copolymer (C) is a copolymer of 2-ethylhexyl methacrylate and a mixture of monomers comprising (C10) alkyl methacrylate, (C12) alkyl methacrylate, (C14) alkyl methacrylate, (C16) alkyl methacrylate and (C18) alkyl methacrylate.

In another preferred embodiment, copolymer (C) of the invention is a copolymer of a mixture of monomers comprising (C10) alkyl methacrylate, (C12) alkyl methacrylate, (C14) alkyl methacrylate, (C16) alkyl methacrylate and (C18) alkyl methacrylate, and a (C8)alkyl methacrylate monomer, in which the weight ratio of the monomer mixture to the (C8) alkyl methacrylate monomer is from about 99:1 to about 10:90.

In another preferred embodiment, copolymer (C) of the invention is a copolymer of a mixture of monomers comprising at least, or preferably consisting of, a (C8) alkyl methacrylate, a (C12) alkyl methacrylate, a (C14) alkyl methacrylate and a (C16) alkyl methacrylate, and are contained in the mixture in a weight ratio of:

from 5 to 30 weight % of (C8) alkyl methacrylate;

from 40 to 70 weight % of (C12) alkyl methacrylate;

from 12 to 35 weight % of (C14) alkyl methacrylate;

from 1 to 12 weight % of (C16) alkyl methacrylate;

from 0.1 to 15%, preferably from 0.5 to 10%, more preferably from 1 to 5 weight % of other methacrylates, relative to the total weight of the mixture.

In general, the copolymers (C) of the invention have a mean radius of gyration (Rg), measured by Hydrodynamic Column Chromatography-Multi Angle Light Scattering (HCC-MALS) typically in a tetrahydrofuran solvent, of between about 100 and about 200 (nm) Rg, preferably between about 120 and about 190 (nm), more preferably between about 130 and about 180, further preferably between about 140 and about 170 (nm) Rg.

Copolymer (C) of the invention can be synthesized using any conventional vinyl-addition polymerization method known to skilled persons, e.g. solution polymerization, precipitation polymerization, dispersion polymerization including suspension and emulsion polymerization.

In one embodiment, the polymer is formed by suspension polymerization, in which the non-water-soluble monomers or scarcely water-soluble are suspended in the form of droplets in water. The monomer droplets are held in suspension by mechanical stirring and addition of stabilizers. Polymeric surfactants such as cellulose ethers, poly(vinyl alcohol-co-vinyl acetate), poly(vinyl pyrrolidone) and polymer alkali metal salts comprising (meth)acrylic acid and (water-insoluble) colloids of inorganic powders such as tricalcium phosphate, hydroxyapatite, barium sulfate, kaolin, and magnesium silicates can be used as stabilizer. In addition, small amounts of surfactants such as sodium dodecylbenzene sulfonate can be used in combination with one or more stabilizers. Polymerization is initiated using an oil-soluble initiator. Suitable initiators include peroxides such as benzoyl peroxide, peroxy esters such as tert-butylperoxy-2-ethylhexanoate, and azo compounds such as 2,2'-azobis(2-methylbutyronitrile). On completion of polymerization, the solid polymer product can be separated from the reaction medium by filtering, and washed with water, acid, base or solvent to remove the monomers that have not reacted or the free stabilizers.

In another embodiment, the polymer is formed by emulsion polymerization, one or more monomers are dispersed in an aqueous phase and polymerization is initiated using a water-soluble initiator. The monomers are typically water-insoluble or scarcely water-soluble and a surfactant or soap is used to stabilize the droplets of monomers in the aqueous phase. Polymerization takes place in the swollen micelles and latex particles. Other ingredients which may be present in emulsion polymerization are particularly phase transfer agents such as mercaptans (e.g. dodecyl mercaptan) to control molecular weight, electrolytes to control pH and small amounts of organic solvent, preferably a water-soluble organic solvent including but not limited to acetone, 2-butanone, methanol, ethanol and isopropanol, to adjust the polarity of the aqueous phase. Initiators which can be used are particularly alkali metal salts or ammonium persulfate, water-soluble azo compounds such as 2,2'-azobis(2-aminopropane)dihydrochloride, and redox systems such as Fe(II) and cumene hydroperoxide, and tert-butyl hydroperoxide-Fe(II)-sodium ascorbate. Surfactants which can be used notably include anionic surfactants such as fatty acid soaps (e.g. sodium or potassium stearate), sulfates and sulfonates (e.g. sodium dodecyl 20 benzene sulfonate), sulfosuccinates (e.g. dioctyl sodium sulfosuccinate); nonionic surfactants such as octylphenol ethoxylates and linear or branched alcohol ethoxylates; cationic surfactants such as cetyl trimethyl ammonium chloride; and amphoteric surfactants. Anionic surfactants and combinations of anionic and nonionic surfactants are the most often used. Polymeric stabilizers such as poly(vinyl alcohol-co-vinyl acetate) can also be used as surfactants. The solid polymer product free of aqueous medium can be obtained with different methods including destabilization/coagulation of the final emulsion followed by filtration, solvent precipitation of the polymer from the latex or latex atomization.

The polymer can be isolated by conventional methods known to skilled persons such as solvent exchange, solvent evaporation, atomization and freeze-drying.

The characteristics of the copolymer obtained by combining alkyl methacrylate monomers, said alkyl methacrylate monomers comprising at least:

one or more monomers (A) selected from among (C6-C10) alkyl methacrylates;

one or more monomers (B) selected from among (C10-C18) alkyl methacrylates;

can be controlled by controlling additional reagents added to the reaction medium.

These reagents include, but are not limited to, initiator and surfactant systems.

The type and quantity of initiator systems used in the polymerization medium can impact the properties of the resulting polymer. An initiator system can be a single initiator compound (e.g. persulfate salt) or a mixture of two more compounds (e.g. hydrogen peroxide and sodium ascorbate). In some examples, the initiator system can include an oxidant, a reducer and optionally a metal salt. The oxidant can be a persulfate e.g. ammonium persulfate, or a peroxide such as hydrogen peroxide ($H_2O_2$) or tert-butyl hydroperoxide (TBHP). The desired copolymer can be obtained for example when the polymerization medium comprises tert-butyl hydroperoxide in an amount of about 0.01 to about 0.06 weight % relative to the weight of all the monomers in the mixture. In other examples, the mixture may comprise tert-butyl hydroperoxide in an amount of about 0.01 to about 0.03 weight % of the mixture of monomers. In other examples, the mixture also comprises tert-butyl hydroperoxide in an amount of 0.013 weight % of the mixture of monomers. Usual initiators of the copolymers of the invention include conventional redox initiators.

In one embodiment, the reducer of the redox initiator system can be ascorbic acid or one of the salts thereof. For example, the polymerization mixture can include sodium ascorbate in an amount of about 0.04 to about 0.1 weight % of the mixture of monomers. In other examples, the sodium ascorbate can be present in an amount of about 0.08 to about 0.1 weight % of the mixture of monomers. In other embodiments, the polymerization mixture comprises sodium ascorbate in an amount of about 0.098 weight % of the mixture of monomers.

The initiator system can also include a metal salt. The metal can be any transition metal such as iron. In one embodiment, the metal salt of the initiator system can be iron sulfate ($FeSO_4$). In another embodiment, the metal salt is contained in the polymerization mixture in an amount of about 0.0005 to about 0.1 weight % of the mixture of monomers. In some examples, the metal salt is added to the polymerization mixture in the form of a solution.

The copolymer can also be in the form of a mixture also comprising a surfactant. In one embodiment, the surfactant may comprise a sulfonate group. For example, the surfactant can include a dialkyl sulfosuccinate, such as the sodium salt of dioctyl sulfosuccinate. For example, the surfactant can be Aerosol® OT.

The copolymer can be a statistical copolymer, block copolymer or mixture thereof. In one embodiment, the copolymer is substantially a statistical copolymer (for example greater than 90, 95, 98, or 99% by weight). The copolymer can also be a partially statistical and partially block copolymer. In this case, the weight ratio of statistical copolymer to block copolymer is generally 90:10, 80:20, 70:30, 60:40, 50:50, 40:60, 30:70, 20:80 or 10:90. The copolymer can also be substantially a block copolymer (for example greater than 90, 95, 98, or 99% by weight). In other examples, the copolymer (C) of the invention may comprise other monomers in addition to monomers (A) selected from among (C6-C10) alkyl methacrylates, and to monomers (B) selected from among (C10-C18) alkyl methacrylates. These additional monomers can be contained in an amount of less than 25 weight %, preferably less than 10 weight %. In one embodiment, the additional monomers are contained in an amount of about 0.5 to 10 weight %, or about 1 to 10 weight % or about 1 to about 5 weight %, or about 5 to 10 weight %. In another embodiment, the monomers are contained in an amount of less than 10, 9, 8, 7, 6, 5, 4, 3, 2, 1 or about 0.5 weight %. The additional monomers can include for example (C1-05) alkyl methacrylates and (C19-024) alkyl methacrylates, crosslinkable monomers, (C1-024) alkyl acrylates, styrene, and other similar monomers.

Copolymer (C) can also be crosslinked. The copolymer may therefore comprise monomer units linking one or more chains of the polymer backbone. In some examples, the copolymer contains crosslinked monomer units in an amount ranging up to about 5 weight % of the copolymer. In another embodiment, the copolymer of the invention is not crosslinked and is substantially free of monomers having a function of crosslinking agent. In other embodiments, the mixture of monomers to obtain the copolymer is substantially free of crosslinking agents.

In the meaning of the present invention, the expression "copolymer substantially free of crosslinking agents" it is meant that the copolymer comprises less than 1.0 weight %, preferably less than 0.5 weight % of monomer units linking one or more chains of the polymer backbone, relative to the total weight of the copolymer.

The crosslinked copolymer can be obtained by adding a crosslinking agent when the mixture of monomers comprises said crosslinking agent. In one embodiment, the crosslinking agent is a diacrylate or dimethacrylate crosslinking agent e.g. 1,6-hexanediol dimethacrylate. For example, the mixture can include a crosslinking agent in an amount of up to about 0.005 weight % of the monomers in the mixture.

For example, a method for preparing the copolymer (C) is described below. The method includes polymerization of monomers (A) selected from among (C6-C10) alkyl methacrylates and of monomers (B) selected from among (C10-C18) alkyl methacrylates, advantageously the polymerization of a mixture of monomers comprising C10 alkyl methacrylate, C12 alkyl methacrylate, C14 alkyl methacrylate, C16 alkyl methacrylate and C18 alkyl methacrylate, and of C8 alkyl methacrylate, in which the weight ratio of monomers (B)/monomers (A) in the copolymer is about 99:1 to about 10:90 (e.g. 10:90, 15:85, 20:80, 25:75, 30:70, 35:65, 40:60, 45:55, 50:50, 55:45, 60:40, 65:35, 70:30, 75:25, 80:20, 85:15, 90:10, 95:5, 99:1).

The method includes: the combining of monomers (A) selected from among (C6-C10) alkyl methacrylates and of monomers (B) selected from among (C10-C18) alkyl methacrylates, advantageously the combining of a mixture of monomers comprising C10 alkyl methacrylate, C12 alkyl methacrylate, C14 alkyl methacrylate, C16 alkyl methacrylate and C18 alkyl methacrylate, with C8 alkyl methacrylate in a mixture/C8 alkyl methacrylate weight ratio of about 10:90, 15:85, 20:80, 25:75, 30:70, 35:65, 40:60, 45:55, 50:50, 55:45, 60:40, 65:35, 70:30, 75:25, 80:20, 85:15, 90:10, 95:5 or 99:1 and initiation of polymerization of the monomers to give the copolymer.

For example, the ratio of monomers and initiators, or initiator system, can be selected as described above. The method can include other compounds to give a copolymer with the desired properties. For example, the method may also include a surfactant e.g. Aerosol® OT, or a crosslinker e.g. 1,6-hexanediol dimethacrylate.

Polymerization can be conducted in an aqueous medium or in a mixture comprising an aqueous solvent and an organic solvent. For example, the polymerization medium can include a mixture of water and acetone. In one embodiment, the polymerization medium may require an organic solvent. It may be advantageous to include an organic solvent when (C10-C18) alkyl methacrylate monomers are used. Organic solvents which can be used for said polymerization reaction are known and can be chosen by those skilled in the art. Organic solvents which can be used are in particular acetone, 2-butanone, methanol, ethanol and isopropanol.

Copolymer (C) is preferably used in an amount of 50 to 10000 ppm by weight, preferably from 100 to 1000 ppm by weight of active material relative to the total weight of the lubricant composition.

The lubricant composition of the invention may also comprise detergents in particular detergents well known to skilled persons.

In one particular embodiment of the invention, the detergents commonly used in the formulation of lubricant compositions are typically anionic compounds having a long lipophilic hydrocarbon tail and hydrophilic head. The associated cation is typically a metal cation of an alkali or alkaline-earth metal. The detergents are preferably selected from among the alkali or alkaline-earth metal salts of carboxylic, sulfonate salicylate, naphthenate acids, and phenate salts. The alkali and alkaline-earth metals are preferably calcium, magnesium, sodium or barium. These metal salts may contain the metal in approximately stoichiometric amount. In this case, the term non-overbased or "neutral" detergents is used, although they contribute some basicity. These "neutral" detergents typically have a BN measured in accordance with ASTM D2896 of less than 200 mg KOH/g, or less than 190, or even less than 180 mg KOH/g. These types of so-called neutral detergents can partly contribute to the BN of the lubricants of the present invention. For example, use is made of neutral detergents of carboxylate, sulfonate, salicylate, phenate, naphthenate type of alkali and alkaline-earth metals e.g. calcium, sodium, magnesium, barium. When the metal is in excess (greater amount than the stoichiometric amount) the detergents are said to be overbased. They have a high BN, higher than 150 mg KOH/g, typically between 200 and 700 mg KOH/g, in general between 250 and 450 mg KOH/g. The excess metal imparting the overbased nature to the detergent is in the form of oil-insoluble metal salts e.g. carbonate, hydroxide, oxalate, acetate, glutamate, preferably carbonate. In one same overbased detergent, the metals of these insoluble salts can be the same as those of oil-soluble detergents or they may differ. They are preferably selected from among calcium, magnesium, sodium or barium. Overbased detergents are in the form of micelles composed of insoluble metal salts held in suspension in the lubricant composition by detergents in the form of oil-soluble metal salts. These micelles may contain one or more types of insoluble metal salts, stabilized by one or more types of detergents. Overbased detergents comprising a single type of soluble metal salt are generally named after the type of hydrophobic chain of this detergent. They are therefore said to be of carboxylate, phenate, salicylate, sulfonate, naphthenate type depending on whether this detergent is respectively a carboxylate, phenate, salicylate, sulfonate, or naphthenate. Overbased detergents are said to be of mixed type if the micelles comprise several types of detergents differing in their type of hydrophobic chain. For use in the lubricant compositions of the present invention, the oil-soluble metal salts are preferably carboxylates, phenates, sulfonates, salicylates, and mixed phenate-sulfonate and/or mixed calcium, magnesium, sodium or barium salicylate detergents. The insoluble metal salts imparting the overbased nature are carbonates of alkali and alkaline-earth metals, preferably calcium carbonate or magnesium carbonate. The overbased detergents used in the lubricant compositions of the present invention are preferably carboxylates, phenates, sulfonates, salicylates and mixed phenate-sulfonate or salicylate detergents overbased with calcium carbonate or magnesium carbonate.

Preferably, the lubricant composition comprises from 4 to 30 weight % of detergents relative to the total weight of the lubricant composition, preferably from 5 to 25% e.g. from 6 to 25 weight %.

Preferably, the lubricant composition has a BN determined in accordance with standard ASTM D-2896 of 70 milligrams or less of potash per gram of lubricant, more preferably of 60 milligrams or less.

Advantageously, the lubricant composition has a BN determined in accordance with standard ASTM D-2896 of between 3 and 50 milligrams of potash per gram of lubricant, preferably between 4 and 40 milligrams of potash per gram of lubricant.

In one particular embodiment of the invention, the base oil included in the lubricant composition is selected from among oils of mineral, synthetic or vegetable origin and the mixtures thereof.

Mineral or synthetic oils generally used in the application belong to one of the classes defined under API classification such as summarized in the table below.

TABLE 1

| | Saturates content | Sulfur content | Viscosity Index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydro-isomerized oils | ≥90% | ≤0.03% | ≥120 |
| Group 4 | PAO | | |
| Group 5 | Other base oils not included in base groups 1 to 4 | | |

The mineral oils in Group 1 can be obtained by distilling selected naphthenic or paraffinic crude oils followed by purification of these distillates by processes such as solvent extraction, solvent or catalytic de-waxing, hydro-treatment or hydrogenation.

Oils in Groups 2 and 3 are obtained by more severe purification processes e.g. a combination from among hydro-treatment, hydrocracking, hydrogenation and catalytic dewaxing.

Synthetic base oils in Groups 4 and 5 can be selected from among esters, silicones, glycols, polybutene, polyalphaolefins (PAO), alkylbenzene or alkylnaphthalene. The polyalphaolefins used as base oils are obtained for example from monomers having 4 to 32 carbon atoms e.g. from octene or decene having viscosity at 100° C. of between 1.5 and 15 $mm^2 \cdot s^{-1}$ according to standard ASTM D445. Their average molecular weight is generally between 250 and 3000 according to standard ASTM D5296.

The base oils can also be oils of natural origin e.g. esters of alcohols and carboxylic acids able to be obtained from natural resources such as sunflower seed, rapeseed, palm oils, soybean etc.

These base oils can be used alone or in a mixture. A mineral oil can be combined with a synthetic oil.

Cylinder oils for 2-stroke diesel marine engines typically have a viscosity grade of SAE-40 to SAE-60, generally SAE-50 equivalent to kinematic viscosity at 100° C. of between 16.3 and 21.9 $mm^2/s$.

Grade 40 oils have kinematic viscosity at 100° C. of between 12.5 and 16.3 $mm^2/s$.

Grade 50 oils have kinematic viscosity at 100° C. of between 16.3 and 21.9 $mm^2/s$.

Grade 60 oils have kinematic viscosity at 100° C. of between 21.9 and 26.1 $mm^2/s$.

According to professional practice, cylinder oils for 2-stroke diesel marine engines can be formulated to have kinematic viscosity at 100° C. of between 18 and 21.5, preferably between 19 and 21.5 $mm^2/s$.

This viscosity can be obtained by mixing additives and base oils for example containing Group 1 mineral bases such as Neutral Solvent bases (e.g. 500 NS or 600 NS) and Brightstock and/or Group 2 mineral bases. Any other combination of mineral bases whether synthetic or of vegetable origin in a mixture with additives having viscosity comparable with grade SAE-50 can be used.

In one embodiment, the lubricant composition comprises at least 40 weight % of base oil(s), preferably at least 50 weight % of base oil(s), more preferably at least 60 weight % of base oil(s), even at least 70 weight % of base oil(s) relative to the total weight of the lubricant composition.

Typically, a conventional formulation of cylinder lubricant for slow 2-stroke diesel marine engines is grade SAE 40 to SAE 60, preferably SAE 50 (according to SAE J300 classification) and comprises at least 50 weight % of one or more lubricant base oils of mineral and/or synthetic origin adapted for use in a marine engine e.g. in Group 1 and/or Group 2 of the API classification i.e. obtained by distillation of selected crude oils and purification of these distillates by processes such as solvent extraction, solvent or catalytic dewaxing, hydrotreatment or hydrogenation. For Group 1 base oils, their Viscosity Index (VI) is between 80 and 120; the sulfur content is greater than 0.03% and saturates content less than 90%. For Group 2 base oils, their Viscosity Index (VI) is between 80 and 120; the sulfur content is 0.03% or less and saturates content 90% or higher.

In one particular embodiment of the invention, the lubricant composition may also comprise one or more thickening additives having the function of increasing the hot and cold viscosity of the composition, or additives improving the viscosity index (VI).

Preferably, these additives are most often polymers of low number-averaged molecular weight of approximately 2000 to 50 000 Dalton (Mn).

They can be selected from among PIBs (approximately 2000 Dalton), poly-Acrylate or poly Methacrylates (approximately 30000 Dalton), Olefin-copolymers, Copolymers of Olefins and Alpha Olefins, EPDM, Polybutenes, Poly-Alphaolefins of high molecular weight (viscosity 100° C.>150), Styrene-Olefin copolymers, whether or not hydrogenated.

In one particular embodiment of the invention, the base oil(s) included in the lubricant composition of the invention can be partially or fully substituted by these additives.

In this case, the polymers used for partial or full substitution of one or more base oils are preferably the aforementioned thickeners of PIB type (e.g. marketed under the trade name Indopol H2100).

In one particular embodiment of the invention, the lubricant composition may additionally comprise an anti-wear additive.

Preferably, the anti-wear additive is Zinc dithiophosphate or ZDDP. This category also includes various phosphorus-, sulfur-, nitrogen-, chlorine- and boron-containing compounds.

There exists a wide variety of anti-wear additives, but the category the most often used is that of sulfur-phosphorus additives such as metal alkylthiophosphates, in particular Zinc alkylthiophosphates and more specifically Zinc dialkyldithiophosphates or ZDDP.

Amine phosphates, polysulfides in particular sulfur-containing olefins are also frequently employed anti-wear additives.

Anti-wear and extreme pressure additives containing nitrogen and sulfur are also usually found in lubricant compositions, such as metal dithiocarbamates in particular molybdenum dithiocarbamate. Glycerol esters are also anti-wear additives. For example, mention can be made of mono-, di- and trioleates, monopalmitates and monomyristates.

In one particular embodiment of the invention, the lubricant composition may also comprise at least one dispersant.

Dispersants are well-known additives used in the formulation of lubricant compositions, in particular for application in the marine sector. Their primary role is to hold in suspension those particles initially present in the lubricant composition or which come to be formed throughout use in the engine. They prevent agglomeration thereof by acting on steric hindrance. They can also have a synergic effect on neutralization.

The dispersants used as lubricant additives typically contain a polar group associated with a relatively long hydrocarbon chain generally having 50 to 400 carbon atoms. The polar group typically contains at least one nitrogen, oxygen or phosphorus element.

Compounds derived from succinic acid are dispersants particularly employed as lubricant additives. Particular use is made of succinimides, obtained by condensation of succinic anhydrides and amines, the succinic esters obtained by condensation of succinic anhydrides and of alcohols or polyols.

These compounds can then be treated by various compounds in particular sulfur, oxygen, formaldehyde, carboxylic acids and compounds containing boron or zinc to produce borated succinimides for example or zinc-blocked succinimides.

Mannich bases obtained by polycondensation of phenols substituted by alkyl groups, of formaldehyde and primary or secondary amines, are other compounds used as dispersants in lubricants.

Use can be made of a dispersant in the PIB succinimide family e.g. borated or zinc-blocked.

In one particular embodiment of the invention, the lubricant composition may also comprise any type of functional additive adapted for use thereof, for example anti-foam additives which can be polar polymers for example such as polymethylsiloxanes or polyacrylates, antioxidant and/or anti-corrosion additives for example organometallic detergents or thiadiazoles. These are known to skilled persons.

In the present invention, the compositions of the described lubricants refer to compounds taken separately before mixing, on the understanding that said compounds may or may not maintain the same chemical form before and after mixing. Preferably, the lubricants of the present invention obtained by the mixing the compounds taken separately are not in the form of an emulsion or microemulsion.

The lubricant compositions of the invention may also comprise at least one fatty amine selected from among:

amines of formula (I):

$$R_1—[(NR_2)—R_3]_q—NR_4R_5, \quad (I)$$

where:

$R_1$ is a linear or branched, saturated or unsaturated hydrocarbon group having at least 12 carbon atoms and optionally at least one heteroatom selected from among nitrogen, sulfur or oxygen;

$R_2$, $R_4$ or $R_5$ are each independently a hydrogen atom or a linear or branched, saturated or unsaturated hydrocarbon group and optionally comprising at least one heteroatom selected from among nitrogen, sulfur or oxygen;

$R_3$ is a linear or branched, saturated or unsaturated hydrocarbon group having one or more carbon atoms, and optionally comprising at least one heteroatom selected from among nitrogen, sulfur or oxygen, preferably oxygen;

q is higher than or equal to 0, preferably q is higher than or equal to 1, more preferably it is an integer of between 1 and 10, further preferably between 1 and 6, advantageously selected from among 1, 2 or 3;

a mixture of fatty polyalkylamines comprising one or polyalkylamines of formulas (III) and/or (IV):

(III)

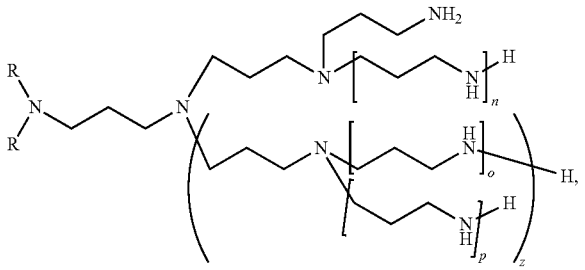

(IV)

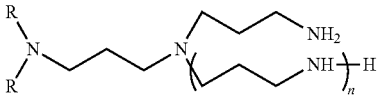

where:

R, the same or different, is a linear or branched alkyl group having 8 to 22 carbon atoms;

n and z are each independently 0, 1, 2 or 3; and when z is higher than 0, o and p are each independently 0, 1, 2 or 3, said mixture comprising at least 3 weight % of branched compounds such that at least one of n or z is higher than or equal to 1, or the derivatives thereof, or mixtures of fatty amines of formulas (I), (Ill) and/or (IV).

Said fatty amines are particularly described in international application WO2018202743.

It is within the reach of those skilled in the art to adapt the quantity of functional additives as a function of the specific use of the lubricant composition.

In one particular embodiment, the lubricant composition employed in the invention comprises at least one additive selected from among detergents, dispersants, and mixtures thereof.

In one specific embodiment, the lubricant composition employed in the invention comprises one or more detergents and one or more dispersants. In this embodiment, if the lubricant composition is used in a marine engine, then the weight proportion of detergent(s) is preferably greater than the weight proportion of dispersant(s), and if the lubricant composition is used in a controlled-ignition engine then the weight proportion of detergent(s) is preferably less than the weight proportion of dispersant(s).

The use of copolymer (C) of the invention in a lubricant composition allows reduced and/or controlled entrainment of droplets (or particles) of lubricant composition by the air intake, thereby limiting the presence of lubricant composition in the combustion chamber, which reduces and/or controls abnormal gas combustion in an engine such as a marine engine or controlled-ignition engine, in particular in a marine engine.

In one particular embodiment of the invention, the engine is a marine engine, in particular a pure gas or dual-fuel engine, two-stroke or four-stroke.

In one particular embodiment of the invention, the use of copolymer (C) of the invention allows the reducing and/or controlling of abnormal gas combustion in an engine, preferably a marine engine, resulting from auto-ignition of the lubricant composition.

In one particular embodiment of the invention, the use of copolymer (C) of the invention in a lubricant composition allows the reducing and/or controlling of abnormal combustion of any type of gas, in particular gas having a low methane number (MN), preferably a methane number of less than 80, more advantageously less than 60.

In general, it is known that the lower the methane number (MN) of a gas the more the phenomenon of abnormal gas combustion is magnified.

The different embodiments, variants, preference and advantages described above can be taken separately or in combination to implement the first subject of the invention.

A further subject of the invention covers a method for reducing the quantity of lubricant composition in the combustion chamber of an engine, the method comprising the use of a copolymer (C) in said lubricant composition. The engine is such as defined above, in particular it can be a marine engine or controlled-ignition engine, preferably the engine is a marine engine.

The copolymer (C) and the lubricant composition are such as defined above.

The different embodiments, preferences, advantages, variants described for the first subject of the invention cover the use of copolymer (C) in a lubricant composition to reduce and/or control abnormal gas combustion in an engine, and apply separately or in combination with the other subjects of the invention covering the above-described method.

The present invention also concerns the use of copolymer (C) or of the lubricant composition of the invention to reduce and/or control abnormal gas combustion in an engine, preferably a marine engine, in particular a pure gas or dual-fuel marine engine, two-stroke or four-stroke.

The present invention also concerns the use of copolymer (C) or of the lubricant composition of the invention to reduce and/or control abnormal gas combustion in an engine, preferably a marine engine, resulting from auto-ignition of the lubricant composition.

The use according to the invention concerns any type of gas, in particular gas having a low methane number (MN), preferably a methane number lower than 80, more advantageously lower than 60.

The present invention also concerns a method for reducing and/or controlling abnormal gas combustion in an engine, comprising the lubrification of the engine with a lubricant composition of the invention or a lubricant composition comprising at least one copolymer (C) of the invention. The engine being such as defined above, preferably the engine is a marine engine, in particular of pure gas or dual-fuel type, two-stroke or four-stroke.

The present invention also concerns a method for reducing and/or controlling abnormal gas combustion in an engine resulting from auto-ignition of the lubricant composition, comprising the lubrification of the engine with a lubricant composition of the invention or a lubricant composition comprising at least one copolymer (C) of the invention. The engine being such as defined above, preferably the engine is a marine engine in particular of pure gas or dual-fuel type, two-stroke or four-stroke.

The methods of the invention concern any type of gas, in particular gas having a low methane number (MN), preferably a methane number lower than 80, more advantageously lower than 60.

BRIEF DESCRIPTION OF THE DRAWINGS

The invention is illustrated by the following examples that are nonlimiting.

DETAILED DESCRIPTION OF AN EXAMPLE

Figure 1:
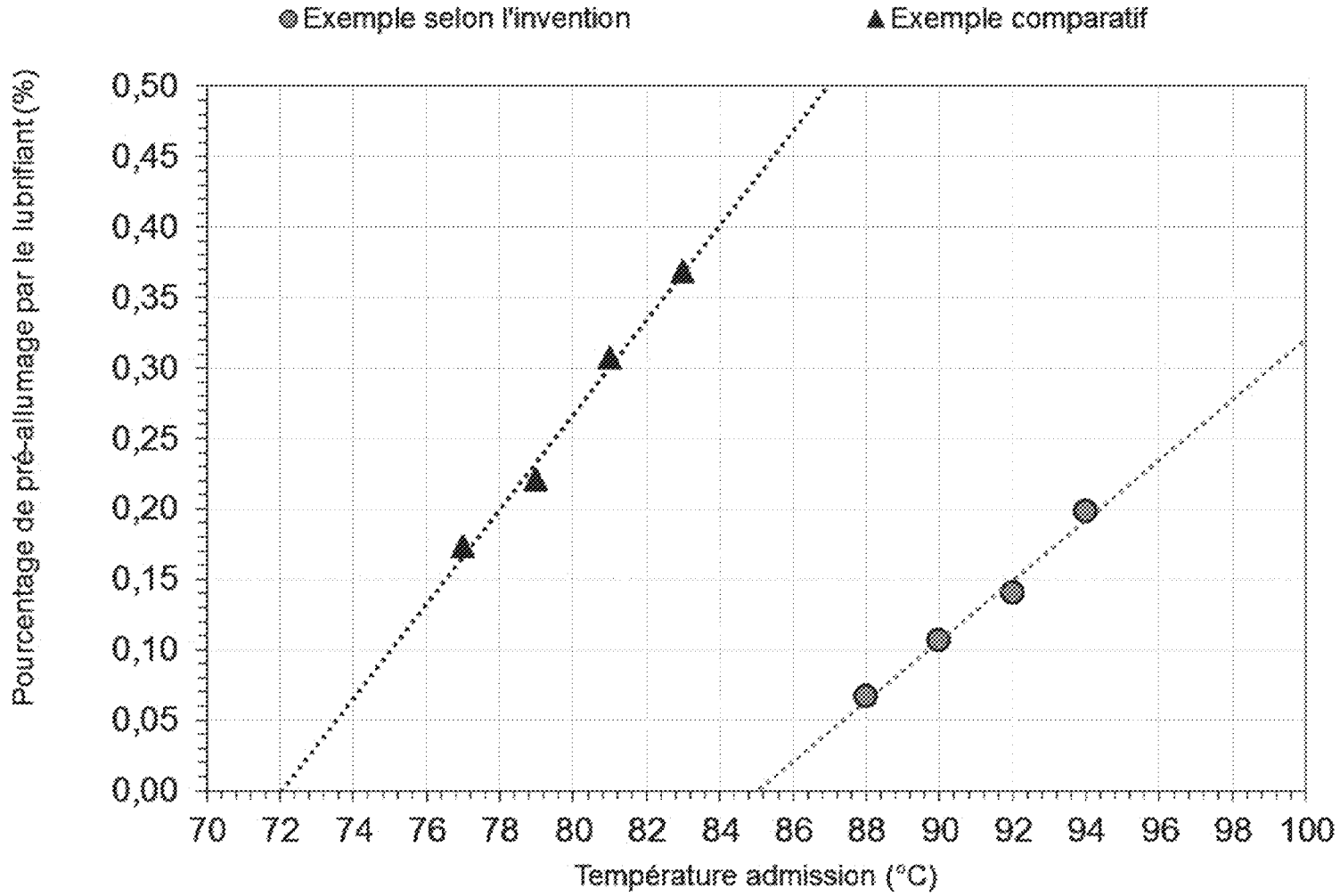
FIG. 1 translates percentage pre-ignition by the lubricant as a function of intake temperature.

The test for measuring the frequency of pre-ignitions of the gas mixture when using different lubricant compositions was conducted on a single-cylinder gas-powered engine comprising a combustion chamber with a bore size of 108 mm and stroke of 115 mm with a compression rate of 11.4, corresponding to a displacement of 1054 $cm^3$ of the single cylinder.

The rotation speed of the single-cylinder engine was 1000 rpm. The chosen operating point was equivalent to an Indicated Mean Effective Pressure IMEP of 23 bar, corresponding to an application representing a heavy engine load.

The ignition system of the single cylinder gas engine used "open-chamber" spark plug technology so that it was possible to repeat the ignition command with precision on each engine combustion cycle. The single-cylinder gas engine was also fitted with a cylinder pressure sensor to measure the trend in pressure in the cylinder, to determine the maximum cylinder pressure values at each engine cycle and to calculate released energy during a combustion cycle.

Prior to the test for measuring abnormal gas combustion in the combustion chamber, a mixture was prepared composed of gas having a methane number equivalent to 70% and of air comprising nitrogen and oxygen with an excess air ratio (air/gas) of 1.6 compared with the stoichiometric ratio used for combustion of the gas.

To observe the effect of the lubricant on the phenomenon of abnormal combustion, the air/gas mixture was heated to a temperature of about 55° C. then gradually increased up to a maximum temperature of 110° C., and compressed to 3.6 bar when entering the single-cylinder gas engine.

The following compositions in Table 2 were tested.

TABLE 2

| | Comparative example | Example of the invention |
|---|---|---|
| Base oil (weight %) | 89.08 | 87.08 |
| Composition of copolymer (C) | — | 2 weight % of a base oil composition comprising 0.1 weight % of dry matter of copolymer (C) |
| Additives | 10.92 | 10.92 |

Copolymer (C) was obtained with the following protocol:

A four-necked flask, fitted with a stirrer, a condenser, a thermocouple and nitrogen purge, was charged with 645.5 g of water and 8.7 g of Aerosol®OT. Stirring was set at 200 rpm and the nitrogen purge set in operation. To the reaction mixture were added 240 g of C10-C18 alkyl methacrylate, 60 g of 2-ethylhexyl methacrylate and 129.9 g of acetone. The reaction medium was heated to 43° C. via a water bath adjusted at 45° C. When the reaction medium reached 43° C., 0.04 g of t-butyl hydroperoxide in 7.5 g of water were added. After 5 minutes, 0.29 g of sodium ascorbate dissolved in 7.5 g of water and 0.60 g of 0.25% solution of iron sulfate hexahydrate were added. Nitrogen purging was replaced by nitrogen inerting. The reaction was left to continue for 5 hours after which the reaction mixture was left to cool to room temperature and isolated.

Example 1. Experimental Protocol for Measuring the Frequency of Pre-Ignitions by the Lubricant Before the Ignition Command of the Single-Cylinder Gas Engine, and the Frequency of Abnormal Combustion Generated by Pre-Ignition of the Lubricant The effect of the lubricant on the phenomenon of abnormal combustion was determined on the single-cylinder gas engine by measuring the frequency of pre-ignitions due to the lubricant before the main ignition command of the engine, and the frequency of pre-ignitions by the lubricant generating a rise in cylinder pressure corresponding to abnormal combustion.

To determine the frequency of pre-ignitions due to the lubricant, the heat release rate was measured for each combustion cycle. The ignition command was repeatedly set at −4° crank angle (CA) before the top dead center. Therefore, for each cycle, each rise in heat release starting before −6° crank angle was counted as abnormal pre-ignition generated by the lubricant before the main ignition command of the engine. The test was started at an intake temperature of the air-gas premixture set at about 55° C. Throughout the test, the temperature was gradually increased until a pre-ignition event was observed. The total of these abnormal events, when related to the 15 000 combustion events recorded during the 30 minutes of each test, gave the frequency of abnormal pre-ignition generated by the lubricant before the main ignition command of the engine.

To determine the frequency of pre-ignition by the lubricant generating a rise in cylinder pressure corresponding to abnormal combustion, for each cycle the maximum pressure reached in the cylinder was measured. The test was started at an intake temperature of the air-gas premixture set at about 55° C. Throughout the test, the temperature was gradually increased until a pre-ignition event was observed. The operating point of the single-cylinder gas engine was determined and generated a normal maximum cylinder pressure of 80 bar. In the event of abnormal combustion, it was considered that the maximum cylinder pressure in the combustion chamber should exceed the limit of 120 bar so that the cycle could be counted as abnormal pre-ignition generated by the lubricant. The total of these abnormal events related to all 15 000 combustion events recorded during the 30 minutes of each test gave the frequency of abnormal pre-ignition generated by the lubricant.

This test allowed the evidencing inter alia of the effect of the lubricant on resistance to the phenomenon of pre-ignition of the air/gas mixture due to auto-ignition of the lubricant before the normal ignition command, and the effect of the lubricant on the intensity of the peaks of maximum cylinder pressure in the event of abnormal combustion, representing the energy released by abnormal combustion.

The lubricant compositions in Table 2 were tested.

The results given in FIG. 1 were generated from temperature conditions under which a phenomenon of abnormal combustion was initiated, and translate the intensity of the phenomenon of abnormal combustion.

Figure 2:
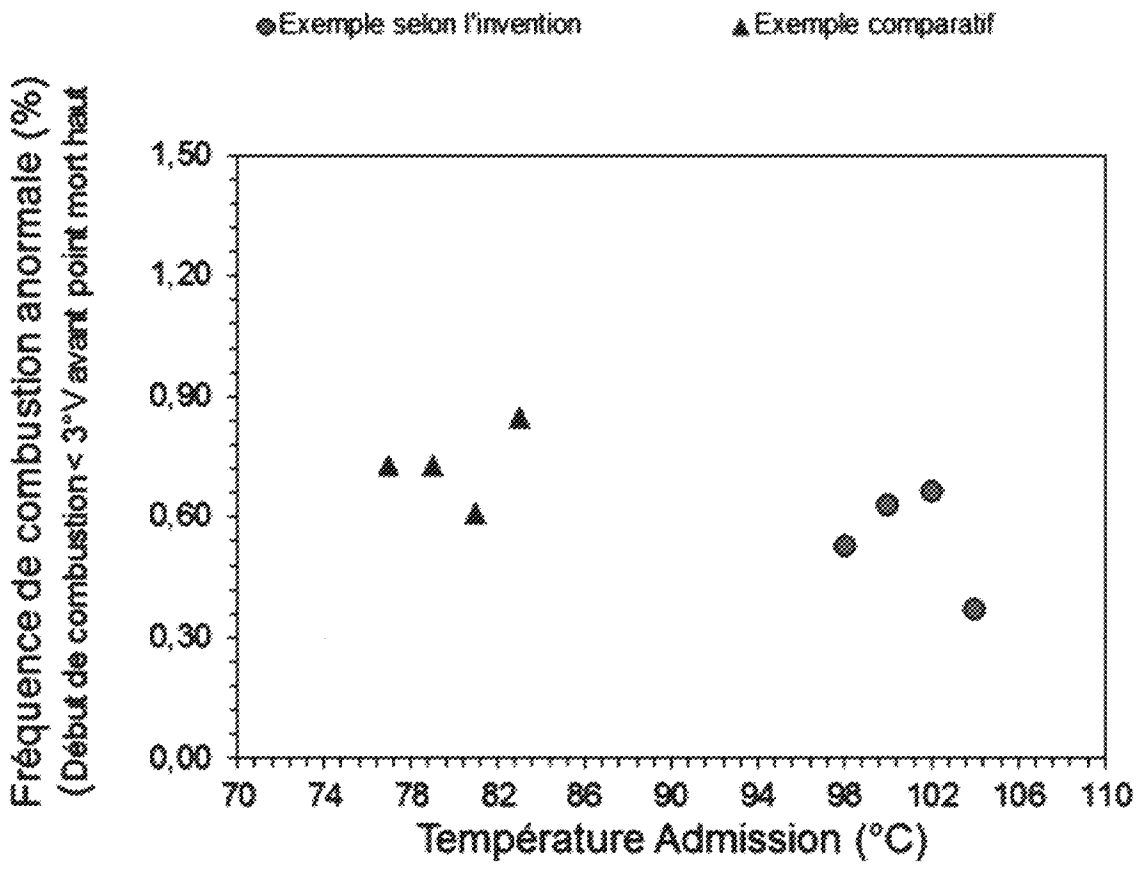
FIG. 2 translates the frequency of abnormal combustion as a function of intake temperature.

The results given in FIG. 2 translate the temperature conditions on and after which there is onset of the phenomenon of abnormal combustion, and the frequency of onsets of this phenomenon over a given cycle.

In FIG. 1 the frequency of pre-ignition by the lubricant composition is measured. It can be seen that this percentage is decreased for the composition of the invention. In addition, it is observed that pre-ignition by the lubricant starts at higher temperatures for the lubricant compositions of the invention.

In FIG. 2, the frequency of abnormal combustion is measured as a function of the intake temperature of the air-gas premixture. It can be seen that the frequency is decreased for the composition of the invention i.e. the frequency of pre-ignitions, also called abnormal combustion, starts at a higher temperature contrary to the comparative composition.

Consequently, from the results in FIGS. 1 and 2, it is seen that the compositions of the invention allow both limitation of the onset of the phenomenon of abnormal combustion and limitation of the intensity thereof, contrary to the comparative composition.

The invention claimed is:

1. A method for reducing and/or controlling abnormal gas combustion in an engine comprising the addition in a lubricating composition comprising at least one base oil of a copolymer (C) comprising repeat units corresponding to alkyl methacrylate monomers, said monomers comprising at least:

one or more monomer(s) (A), the same or different, selected from among (C6-C10) alkyl methacrylate monomers;

one or more monomer(s) (B), the same or different, selected from among (C10-C18) alkyl methacrylate monomers, said monomers (B) differing from said monomers (A).

2. The method according to claim 1, wherein the copolymer (C) comprises repeat units corresponding to:

monomers (A), the same or different, selected from among (C6-C10) alkyl methacrylate monomers;

monomers (B), the same or different, selected from among (C10-C18) alkyl methacrylate monomers, said monomers (B) comprising at least one (C12) alkyl methacrylate monomer and/or at least one (C14) alkyl methacrylate monomer.

3. The method according to claim 1, wherein monomers (A) and monomers (B) represent at least 75 weight % of the total of monomers used to prepared copolymer (C).

4. The method according to claim 1, wherein the weight ratio of monomers (B) to monomers (A) is between about 99:1 and about 10:90.

5. The method according to claim 1, wherein monomers (A) are branched.

6. The method according to claim 1, wherein copolymer (C) comprises units corresponding to C10 alkyl methacrylate, C12 alkyl methacrylate, C14 alkyl methacrylate, C16 alkyl methacrylate, C18 alkyl methacrylate, and C8 alkyl methacrylate monomers.

7. The method according to claim 1, wherein the lubricant composition comprises from 50 to 10000 ppm by weight of active material of copolymer (C) relative to the total weight of the composition.

8. The method according to claim 1, wherein the engine is a marine engine.

9. The method according to claim 1, for reducing the quantity of lubricant composition in the combustion chamber of the engine.

10. A method to reduce and/or control abnormal gas combustion in an engine, comprising the lubrication of the engine with a lubricating oil comprising:

at least one base oil;

at least one copolymer (C) such as defined in claim 1.

11. Method to reduce the quantity of lubricant composition in the combustion chamber of an engine comprising the lubrication of the engine with a lubricating oil comprising:

at least one base oil;

at least one copolymer (C) such as defined in claim 1.

12. Method to reduce and/or control abnormal gas combustion resulting from auto-ignition of the lubricant composition in an engine comprising the lubrication of the engine with a lubricating oil comprising:

at least one base oil;

at least one copolymer (C) such as defined in claim 1.

13. The method according to claim 1, wherein monomers (A) are 2-ethyl-hexyl methacrylate and/or monomers (B) are a mixture of C10 alkyl methacrylate, C12 alkyl methacrylate, C14 alkyl methacrylate, C16 alkyl methacrylate, and C18 alkyl methacrylate.

14. The method according to claim 1, wherein the copolymer (C) comprises 55 to 70 weight % of C12 alkyl methacrylate and 20 to 30 weight % of C14 alkyl methacrylate relative to the total weight of monomers (B).

* * * * *